US010313795B1

(12) United States Patent
Escobar et al.

(10) Patent No.: US 10,313,795 B1
(45) Date of Patent: Jun. 4, 2019

(54) VEHICLE AUDIO SYSTEM

(71) Applicant: Honda Motor Co., Ltd., Tokyo (JP)

(72) Inventors: Edgar Arturo Escobar, Hilliard, OH (US); Christopher L. Steinmeyer, Hilliard, OH (US); David T. Christian, Jr., Troy, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/214,425

(22) Filed: Dec. 10, 2018

Related U.S. Application Data

(63) Continuation of application No. 15/920,998, filed on Mar. 14, 2018, now Pat. No. 10,165,369.

(51) Int. Cl.

| | |
|---|---|
| ***H04R 7/04*** | (2006.01) |
| ***H04R 1/02*** | (2006.01) |
| ***H04R 1/26*** | (2006.01) |

(52) U.S. Cl.
CPC ..... *H04R 7/045* (2013.01); *H04R 1/025* (2013.01); *H04R 1/26* (2013.01); *H04R 2201/028* (2013.01); *H04R 2499/13* (2013.01)

(58) Field of Classification Search
CPC ..... H04R 1/025; H04R 1/26; H04R 7/045; H04R 2201/028; H04R 2499/13
See application file for complete search history.

(56) References Cited

U.S. PATENT DOCUMENTS

| | | | |
|---|---|---|---|
| 4,326,099 A | 4/1982 | Maille | |
| 4,704,729 A | 11/1987 | Franzini et al. | |
| 5,875,250 A | 2/1999 | Kuo et al. | |
| 5,901,231 A | 5/1999 | Parrella et al. | |
| 6,332,029 B1 | 12/2001 | Azima et al. | |
| 6,865,277 B2 | 3/2005 | Bank et al. | |
| 7,194,098 B2 | 3/2007 | Azima et al. | |
| 7,661,749 B2 | 2/2010 | Balcerzak et al. | |
| 8,044,413 B2 | 10/2011 | Albus et al. | |
| 9,154,862 B2 | 10/2015 | Cheung | |
| 9,723,409 B2 | 8/2017 | Smearcheck et al. | |
| 2004/0109575 A1 | 6/2004 | Thigpen | |
| 2004/0258256 A1 | 12/2004 | Ruff | |
| 2005/0013453 A1 | 1/2005 | Cheung | |
| 2005/0084131 A1* | 4/2005 | Fordham | H04R 7/045 381/431 |
| 2008/0089537 A1 | 4/2008 | Scheel et al. | |
| 2010/0272294 A1 | 10/2010 | Arknaes-Pedersen et al. | |
| 2011/0056763 A1 | 3/2011 | Tanase et al. | |
| 2012/0140945 A1 | 6/2012 | Harris | |
| 2016/0165329 A1 | 6/2016 | Fedyay et al. | |

FOREIGN PATENT DOCUMENTS

| | | |
|---|---|---|
| WO | 2017031422 A1 | 2/2017 |

* cited by examiner

*Primary Examiner* — Mark Fischer
(74) *Attorney, Agent, or Firm* — Armstrong Teasdale LLP

(57) ABSTRACT

A method for generating sound by one or more sound panels in a vehicle, and a sound system are provided. The method includes receiving, by an acoustic exciter coupled to one of the one or more sound panels, a first audio signal. The first audio signal includes a first frequency range. Each of the sound panels is formed of a material having a respective flexural modulus. The method further includes generating, by each of the sound panels, a sound signal comprising a respective range of sound pressure vibrations dependent on the flexural modulus of the sound panel, variations of dimensions of the sound panel, and the first audio signal received by the acoustic exciter.

20 Claims, 7 Drawing Sheets

VEHICLE AUDIO SYSTEM

CROSS-REFERENCE TO RELATED APPLICATIONS

This application is a continuation application of U.S. patent application Ser. No. 15/920,998, filed Mar. 14, 2018, which is hereby incorporated by reference in its entirety.

BACKGROUND

This description relates to vehicle audio entertainment and communication systems, and, more particularly, to off-road vehicle sound systems.

At least some known vehicles include audio systems for entertainment, programming, communications, or other audio output. Known audio systems typically include at least one audio source, an amplifier, equalizer, and speakers mounted in the interior cabin of the vehicle. Some vehicles include acoustic exciters coupled to panels that form a part of the vehicle. The acoustic exciters and panels act as drivers and diaphragms similar to speakers. To produce high fidelity sound that includes the frequencies humans can perceive, an equalizer is typically used. However, an equalizer is an expensive piece of electronic equipment that adds weight and occupies room in the vehicle.

BRIEF DESCRIPTION

In one embodiment, a vehicle sound system includes one or more acoustic panel assemblies. Each of the one or more acoustic panel assemblies includes a sound panel formed of a material having a respective flexural modulus and an acoustic exciter coupled to each of the one or more sound panels. Each acoustic exciter is configured to receive a first audio signal containing a first frequency range. Each of the one or more sound panels is configured to generate a sound signal containing a respective range of sound pressure vibrations dependent on the flexural modulus of a material the sound panel is formed of, variations of dimensions of the sound panel, and the first audio signal received by the acoustic exciter coupled to the sound panel.

In another embodiment, a method of generating sound having a plurality of frequency responses includes receiving, by a plurality of acoustic exciters, a single audio signal that includes a plurality of frequency ranges. The plurality of acoustic exciters is coupled to a corresponding plurality of sound panels. Each sound panel is formed of a material having a predetermined flexural modulus. The method also includes generating a range of sound pressure vibrations by the plurality of sound panels respective of the flexural modulus of the panel and the single audio signal.

In yet another embodiment, a speakerless vehicle sound system includes an audio amplifier that includes a first channel configured to provide a first audio signal having a first frequency range and a second channel configured to provide a second audio signal having a second frequency range wherein the second frequency range is less than the first frequency range. The speakerless vehicle sound system also includes a first acoustic exciter communicatively coupled to the first channel and to a first vehicle sound panel formed of a material having a first flexural modulus. The first vehicle sound panel is configured to generate a first range of sound pressure vibrations dependent on the first flexural modulus, a first set of dimensions of the first vehicle sound panel, and the first audio signal. The speakerless vehicle sound system further includes a second acoustic exciter communicatively coupled to the second channel and to a second vehicle sound panel formed of a material having a second flexural modulus. The second flexural modulus is less than the first flexural modulus. The first vehicle sound panel is configured to generate a second range of sound pressure vibrations dependent on the second flexural modulus of material the second vehicle sound panel is formed of, a second set of dimensions of the second vehicle sound panel, and the second audio signal.

BRIEF DESCRIPTION OF THE DRAWINGS

FIG. 1 is schematic illustration of a vehicle audio system showing various speakers operably coupled to an amplifier and various exterior audio assemblies or acoustic exciters operably coupled to the amplifier.

FIG. 2 is a graph of an example frequency response of the vehicle audio system shown in FIG. 1.

FIG. 3 is a side elevation view of an acoustic panel assembly that may be used with the vehicle sound system shown in FIG. 1.

FIG. 4 is a side elevation view of an acoustic panel assembly that may be used with the vehicle sound system shown in FIG. 1 in accordance with another example embodiment of the present disclosure.

FIG. 5 is a side perspective view of acoustic panel assembly during operation of acoustic exciter.

FIG. 6 is a perspective view of a vehicle, such as, but not limited to a side-by-side (S×S) off-road vehicle.

FIG. 7 is a flowchart of an example method of generating sound having a plurality of frequency responses.

Figure 1:
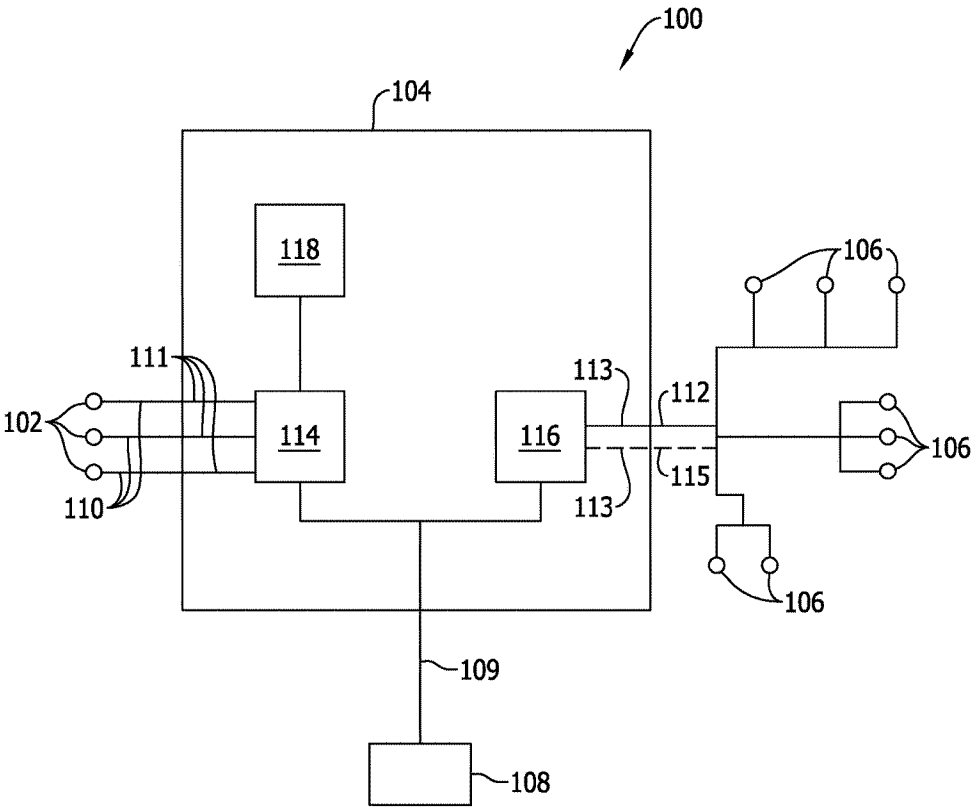
FIGS. 1-7 show example embodiments of the method and systems described herein.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

Various embodiments of the present disclosure are better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., systems, devices, processors, controllers, or memories) may be implemented in a single piece of hardware (e.g., a general purpose signal processor or random access memory, hard disk, or the like) or multiple pieces of hardware. Similarly, any programs may be stand-alone programs, may be incorporated as subroutines in an operating system, may be functions in an installed software package, and the like. It should be understood that the various embodiments are not limited to the arrangements and instrumentality shown in the drawings.

As used herein, the terms "module", "system," or "unit," may include a hardware and/or software system that operates to perform one or more functions. For example, a module, unit, or system may include a computer processor, controller, or other logic-based device that performs operations based on instructions stored on a tangible and non-transitory computer readable storage medium, such as a computer memory. Alternatively, a module, unit, or system may include a hard-wired device that performs operations based on hard-wired logic of the device. The modules, units, or systems shown in the attached figures may represent the hardware that operates based on software or hardwired instructions, the software that directs hardware to perform the operations, or a combination thereof.

As used herein, an element or step recited in the singular and proceeded with the word "a" or "an" should be understood as not excluding plural of the elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Various embodiments of methods and systems for controlling functions of a vehicle audio system are provided. It should be noted that although the various embodiments are described in connection with the automotive industry, such as, but not limited to, a truck, one or more embodiments may be implemented in different types of vehicles, in different industries and for different applications. Additionally, while embodiments described herein refer to a vehicle audio system that provides audio output external to the vehicle, such as in a truck bed of the vehicle, the audio output may be provided at other areas of the vehicle in other various embodiments.

One or more embodiments include a system, which may be implemented as a programmable logic controller (PLC), also referred to as a programmable logic circuit that controls various functions and operations of the audio system of the vehicle, such as the audio input, the audio output, equalization of the audio output, such as to control frequency response of the speakers, such as to control bass, treble and the like, battery saving features, such as to turn off various electrical systems, and the like. The controller may control display functions on one or more display devices or screens.

In various embodiments, the system may include both interior audio assemblies (e.g., speakers in a cabin of the vehicle) and exterior audio assemblies (e.g., acoustic exciters outside of the cabin of the vehicle to produce audio output external to the vehicle cabin). The exterior audio assemblies provide a full range of audio output external to the vehicle, such as for use when people are around the outside of the vehicle. For example, during tailgating, while doing chores, while washing the vehicle and the like, the vehicle audio system may be used and does not need to rely on speakers inside the vehicle cabin to produce the sound. As such, the windows or doors do not need to be open to listen to the audio system.

As used herein, flexural modulus or bending modulus is an intensive property of a material that is computed as the ratio of stress to strain in flexural deformation, or the tendency for the material to bend. The flexural modulus is inversely related to deflection—a lower deflection results in a higher flexural modulus. In other words, a higher flexural modulus material is "stiffer" than a lower flexural modulus material.

The following description refers to the accompanying drawings, in which, in the absence of a contrary representation, the same numbers in different drawings represent similar elements.

FIG. 1 is schematic illustration of a vehicle audio system 100 having speakers 102 operably coupled to an amplifier 104 and various exterior audio assemblies or acoustic exciters 106 operably coupled to amplifier 104. Although vehicle audio system 100 is illustrated showing an interior audio system that includes speakers, vehicle audio system 100 may also be configured without the interior portion. An audio source device 108 provides a low power audio signal 109 to amplifier 104. In various embodiments, audio source device 108 may be embodied in an FM, AM, or satellite radio receiver, a compact disk (CD) or MP3 player, and the like. In the illustrated embodiment, amplifier 104 is configured to amplify low power audio signal 109 and to output higher power audio signals 110 over one or more channels 111. Each speaker 102 is communicatively coupled to a corresponding channel 111 of amplifier 104. Similarly, each acoustic exciter 106 is communicatively coupled to a single channel 112 of amplifier 104, which provides a single higher power audio signal 113. In other embodiments, a second channel 115 may be used to power a portion of acoustic exciters 106.

In the exemplary embodiment, amplifier 104 includes an interior audio module 114 with speakers 102 coupled to interior audio module 114 and an exterior audio module 116 with acoustic exciters 106 coupled to the exterior audio module 116. Various selectable audio modes may operate interior audio module 114 and exterior audio module 116 in conjunction with each other, or one or the other of interior audio module 114 and exterior audio module 116 may be operated individually.

An equalizer 118 is only used with interior audio module 114 and speakers 102. Equalizer 118 may operate speakers 102 at different frequencies. For example, each channel 111 may be operated at a different frequency. Equalizer 118 controls the output of the channels 111 differently from each other of channels 111. Optionally, an output of amplifier 104 may be controlled by equalizer 118 to achieve a desired sound quality target including, but not limited to, factors such as distortion, clarity and frequency response for each of speakers 102. Equalizer 118 may control the output of the channels 111 based on various factors, such as the characteristics of each speaker 102, a mounting location of each speaker 102 within a vehicle. For reasons that are explained below, equalizer 118 is not needed or used with exterior audio module 116 and acoustic exciters 106. Exterior audio module 116 provides an unequalized audio signal 113 to acoustic exciters 106.

Figure 2:
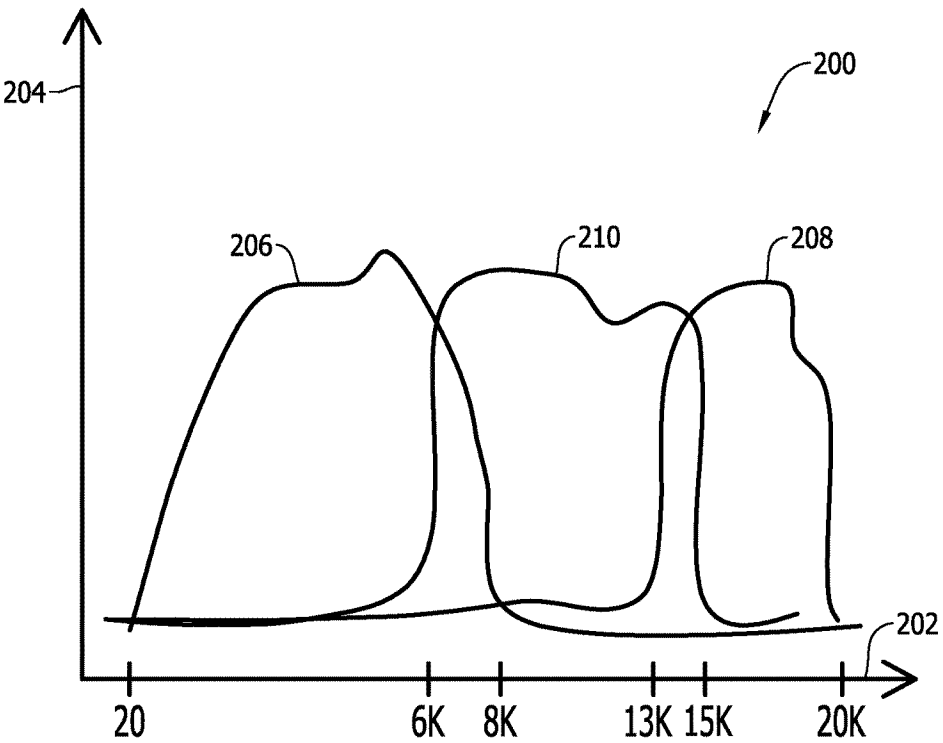

FIG. 2 is a graph 200 of an example frequency response of vehicle audio system 100 (shown in FIG. 1). In the example embodiment, graph 200 includes an x-axis 202 graduated in units of frequency, such as, but not limited to, Hertz (Hz) and a y-axis 204 graduated in units of sound pressure level (SPL) or acoustic pressure graduated in units of for example, Pascal (Pa). A first trace 206 represents a relatively low frequency response, a second trace 208 represents a relatively high frequency response, and a third trace 210 represents a frequency response between low frequency response, first trace 206 and high frequency response, second trace 208. SPL represents a local pressure deviation from the ambient atmospheric pressure, caused by a sound wave.

First trace 206 represents a bass frequency response between approximately 20 Hz and 8,000 Hz. Second trace

208 represents a treble frequency response between approximately 13,000 Hz and approximately 20,000 Hz, Third trace 210 represents a mid-range frequency response between approximately 6,000 Hz and 15,000 Hz, First trace 206, second trace 208, and third trace 210 together represent a full range of frequency responses, which a human typically can hear. Each of first trace 206, second trace 208, and third trace 210 are generated using a single audio signal channeled to identical acoustic exciters (shown in FIG. 3) coupled to one or more sound panels (also shown in FIG. 3) on a vehicle (shown in FIG. 6). A vibratory response of each of the one or more sound panels is predetermined based on a flexural modulus of a material the sound panels are formed of, physical dimensions of the sound panels, dimensional features of the sound panels, stiffening or other flexural treatment of the sound panels, or combinations thereof.

The flexural modulus of the sound panels may be defined by the material properties of the material the sound panels are formed of. For example, a length of a fiber used in the material, the cross-section of the fibers, and a filler material used in forming the sound panel may define a certain flexural modulus of the sound panel. Likewise a density of the material and the mechanical joining of layers of the layer also facilitate defining the flexural modulus of the sound panel.

The flexural modulus of the sound panels may also be defined by physical dimensions of the sound panels. Such physical dimensions include a thickness of the sound panel, a gradient of the thickness across the sound panel, a length, a width, and an overall shape or outline of the sound panel can affect the structural modulus of the sound panel.

The flexural modulus of the sound panels may further be defined by dimensional features of the sound panels, stiffening, or other flexural treatment of the sound panels, including heat treatment and fastening configurations.

Figure 3:
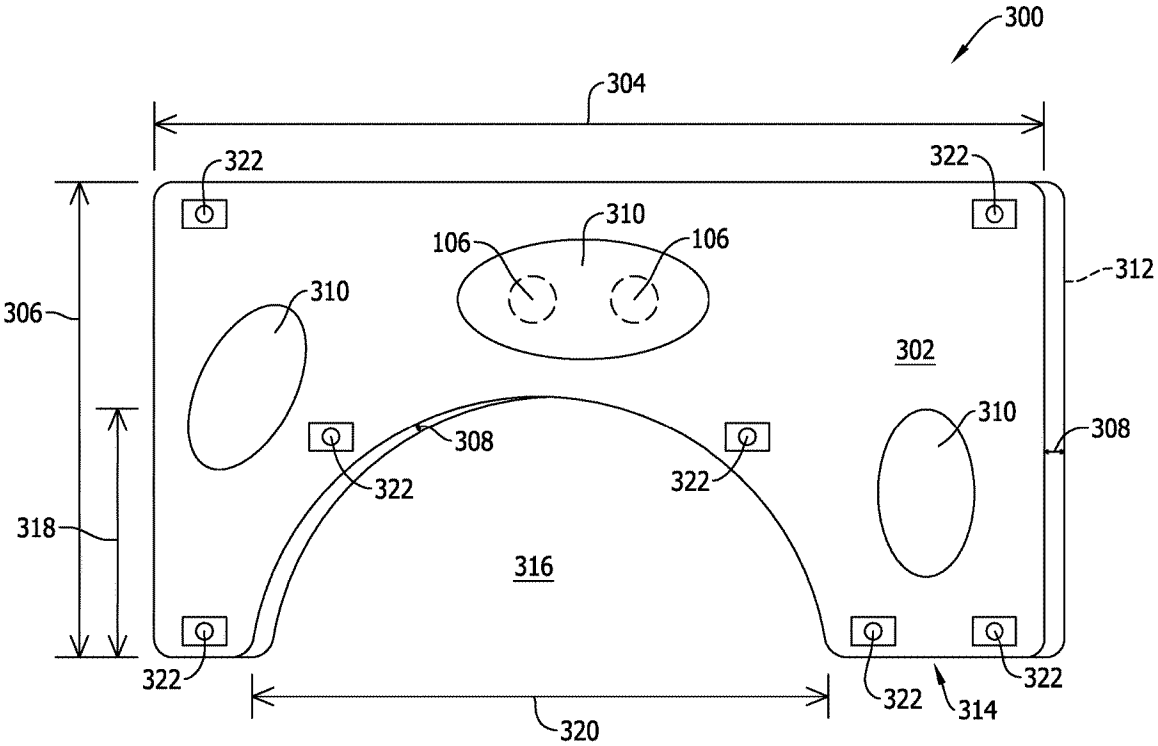
Figure 4:
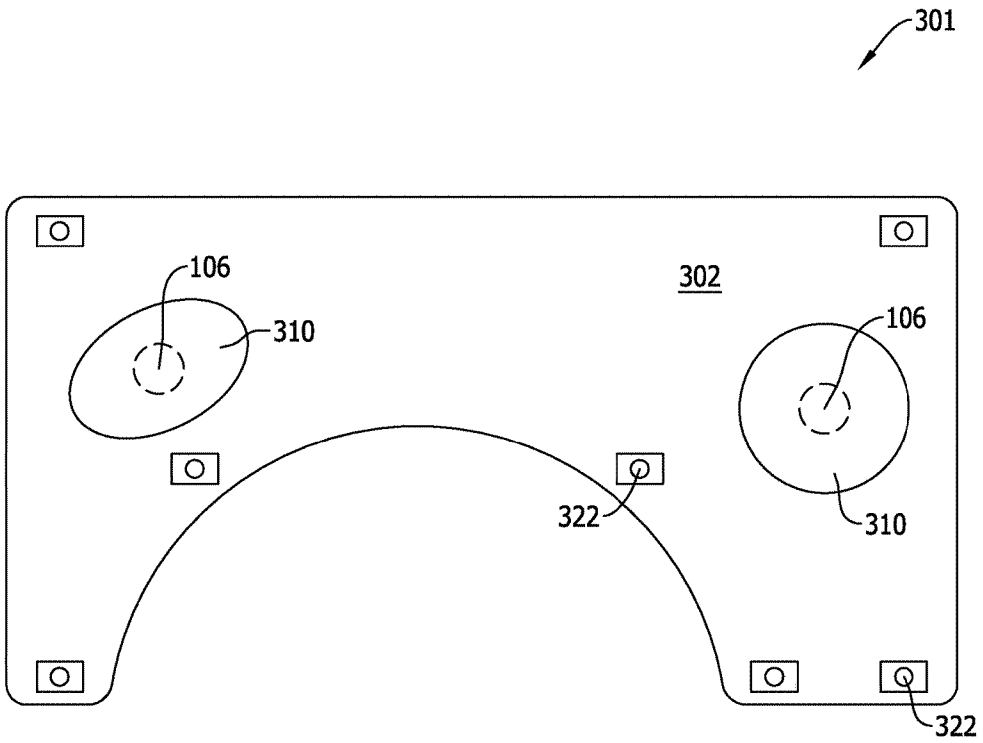

FIG. 3 is a side elevation view of an acoustic panel assembly 300 that may be used with vehicle audio system 100 (shown in FIG. 1). FIG. 4 is a side elevation view of an acoustic panel assembly 301 that may be used with vehicle audio system 100 (shown in FIG. 1) in accordance with another example embodiment of the present disclosure. For example, acoustic panel assembly 300 can define an interior portion of a cargo bed of a vehicle and/or may define an interior portion of, for example, a cab or cabin of a vehicle. In the example embodiment, acoustic panel assembly 300 includes a sound panel 302 formed of a material having a respective flexural modulus. In various embodiments, the flexural modulus is homogeneous across a width 304, height 306, and a thickness 308 of sound panel 302. In other embodiments, the flexural modulus is not homogeneous and may be varied throughout various areas 310 of sound panel 302 to tailor a vibratory response of sound panel 302 to acoustic exciters 106. In FIG. 3, acoustic exciters 106 are shown in dotted lines because they are mounted to an opposite side 312 of sound panel 302. Acoustic exciters 106 are coupled to sound panel 302 in areas predetermined to provide desired sound pressure vibrations. Each acoustic exciter 106 is configured to receive audio signal 113. Audio signal 113 includes a full range of frequency responses including a bass frequency response, a treble frequency response, and a mid-range frequency response (as shown in FIG. 2). Eeach of sound panels 302 is configured to generate an audible sound signal that includes a respective range of sound pressure vibrations dependent on the flexural modulus of material sound panels 302 are formed of, variations of dimensions of the sound panel, and audio signal 113 received by acoustic exciter 106 coupled to sound panels 302.

Acoustic panel assembly 300 may be formed in a plurality of different shapes, such as, as illustrated, as a rectangular shape 314, which may have portions 316 removed to form, in this example, a cutout for a wheel well having a height 318 and a width 320. A plurality of fasteners 322 may be positioned in acoustic panel assembly 300 at predetermined locations to fix acoustic panel assembly 300 to a structure of the vehicle. Fasteners 322 may also provide an adjustable or selectable compressive force when fixing acoustic panel assembly 300 to the structure. Such variable compressive force may be used to tuning a frequency response of acoustic panel assembly 300.

Figure 5:
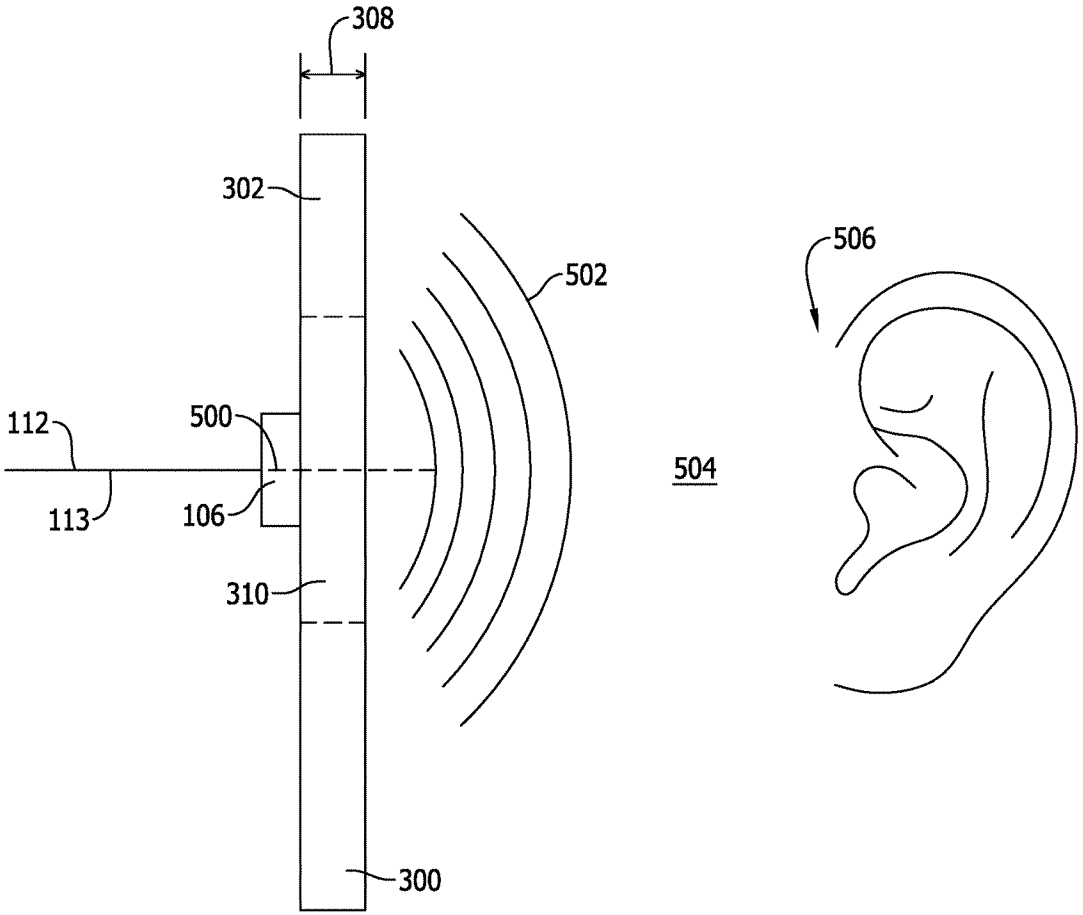

FIG. 5 is a side perspective view of acoustic panel assembly 300 during operation of acoustic exciter 106. Acoustic panel assembly 300 includes acoustic exciter 106 coupled to sound panel 302. In various embodiments, sound panel 302 may be formed as a structural component of the vehicle, a fairing component, and/or a decorative component of the vehicle. During operation, single higher power audio signal 113 is used to excite acoustic exciter 106, which causes acoustic exciter 106 to vibrate at a predetermined rate under the influence of single higher power audio signal 113. The vibrations are generated by acoustic exciter 106 in an axial direction with respect to cylinder axis 500. The vibrations cause a deflection of sound panel 302, which then causes variations 502, for example, compressions and rarefactions in the sound pressure adjacent to sound panel 302. Sound pressure variations 502 travel through the medium 504 of the air ambient to sound panel 302 and an ear 506 of a listener. In various embodiments, vehicle audio system 100 includes a plurality of acoustic panel assemblies 300. Each acoustic exciter 106 associated with the plurality of acoustic panel assemblies 300 receives the same single higher power audio signal 113. To generate high fidelity sound as perceived by ear 506 of the listener, single higher power audio signal 113 excites all acoustic exciters 106 similarly and it is the frequency response of sound panel 302 that splits the full frequency range single higher power audio signal 113 into bass, mid-range, and treble sound ranges based on the flexural modulus, dimensions, structure, etc. of sound panel 302. In at least some known vehicle audio systems, an equalizer is used to separate various frequency ranges of an audio signal before separate different signals are directed to speakers.

Figure 6:
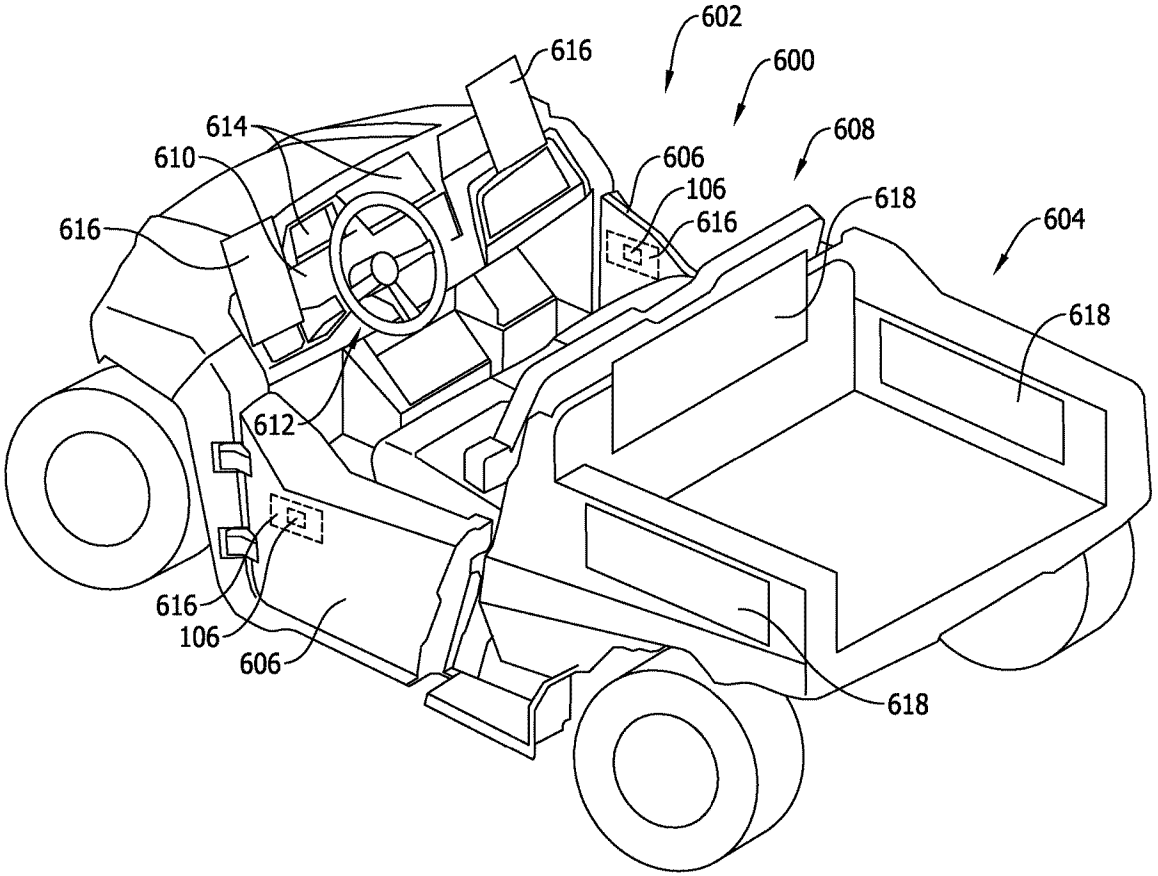

FIG. 6 is a perspective view of a vehicle 600, such as, but not limited to a side-by-side (S×S) off-road vehicle. In the example embodiment, vehicle 600 includes a passenger compartment 602 and a cargo bed 604. Passenger compartment 602 includes doors 606, passenger seats 608, a dashboard, 610, various vehicle controls 612, and indications 614. Doors 606 and dashboard 610 may include areas 616 where sound panel 302 can be positioned and used as part of vehicle audio system 100. Cargo bed 604 may also have areas 618, at which one or more sound panels 302 may also be positioned and used as part of vehicle audio system 100. Selectable factors affecting the frequency response of sound panels 302 include the flexural modulus of the material the sound panel 302 is formed of, the size and shape of the sound panel 302, surface features and structural additions to the sound panel 302, heat treatment or other treatments of sound panel 302. For example, bass and mid-range frequency responses are better suited for more remote placement of the associated acoustic exciter 106 because low frequency travels farther through media than do high frequencies. Additionally, bass response through objects, such as, walls, room dividers, and seat backs is better than high frequency response. Accordingly, placement of sound panels 302 tailored to low and mid-range applications is preferentially made to, for example, the sidewalls of cargo bed 604, whereas placement of sound panels 302 tailored to high frequency applications is preferentially made to, for example, passenger compartment 602.

Figure 7:
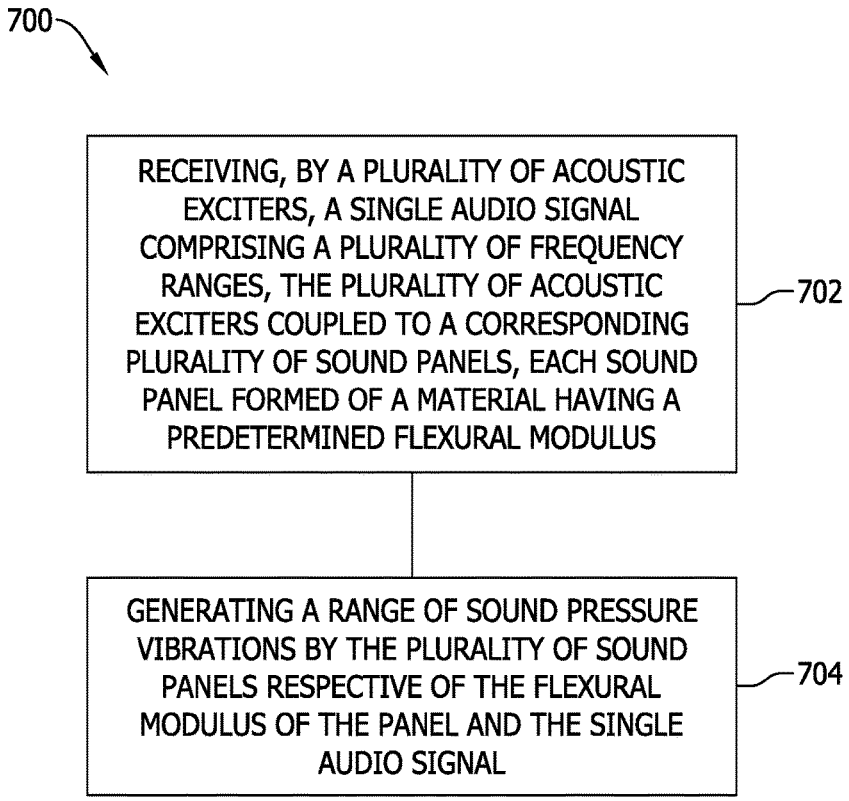

FIG. 7 is a flowchart of an example method 700 of generating sound having a plurality of frequency responses. In the example embodiment, method 700 includes receiving 702, by a plurality of acoustic exciters, a single audio signal including a plurality of frequency ranges including a low frequency range, a mid frequency range, and a high frequency range. The plurality of acoustic exciters are coupled to a corresponding plurality of sound panels. Each sound panel is formed of a material having a predetermined flexural modulus defined by at least one of a material composition of the sound panel, a set of physical dimensions of the sound panel, a mounting configuration of the sound panel, and a combination thereof. Method 1000 also includes generating 704 a range of sound pressure vibrations by the plurality of sound panels respective of the flexural modulus of the panel and the single audio signal.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for generating sound by one or more sound panels in a vehicle, the method comprising:

receiving, by an acoustic exciter coupled to one of the one or more sound panels, a first audio signal comprising a first frequency range, wherein each of the sound panels is formed of a material having a respective flexural modulus; and generating, by each of the sound panels, a sound signal comprising a respective range of sound pressure vibrations dependent on the flexural modulus of the sound panel, variations of dimensions of the sound panel, and the first audio signal received by the acoustic exciter.

2. The method of claim 1, wherein the first audio signal comprises a plurality of sub-ranges of frequencies including a low frequency sub-range, a mid frequency sub-range, and a high frequency sub-range.

3. The method of claim 1, wherein a first sound panel of the one or more sound panels comprises a first material having a first flexural modulus value, and a second sound panel of the one or more sound panels comprises a second material having a second flexural modulus value.

4. The method of claim 3, further comprising generating, by the first sound panel, a first sound signal comprising a first range of sound pressure vibrations using the first material having the first flexural modulus value and the first audio signal; and generating, by the second sound panel, a second sound signal comprising a second range of sound pressure vibrations using the second material having the second flexural modulus value and the first audio signal, the second range of sound pressure vibrations different from the first range of sound pressure vibrations.

5. The method of claim 1, wherein a first sound panel of the one or more sound panels comprises a first set of dimensions including at least a first thickness, and a second sound panel of the one or more sound panels comprises a second set of dimensions including at least a second thickness, wherein at least one of the first thickness and the second thickness comprises a gradient along at least one of a length and a width of the sound panel, the flexural modulus in any area of the sound panel being dependent on the thickness of the sound panel in that area.

6. The method of claim 5, further comprising generating, by the first sound panel, a first sound signal comprising a first range of sound pressure vibrations using the first set of dimensions and the first audio signal; and generating, by the second sound panel, a second sound signal comprising a second range of sound pressure vibrations using the second set of dimensions and the first audio signal, the second range of sound pressure vibrations different than the first range of sound pressure vibrations.

7. A sound system comprising:

a plurality of acoustic exciters configured to receive a single audio signal comprising a plurality of frequency ranges; and a plurality of sound panels, each sound panel formed of a material having a predetermined flexural modulus, and each acoustic exciter coupled to one of the plurality of sound panels, wherein the plurality of sound panels are configured to generate a range of sound pressure vibrations respective of the flexural modulus of the sound panel and the single audio signal.

8. The sound system of claim 7, wherein the single audio signal comprises a low frequency range, a mid frequency range, and a high frequency range.

9. The sound system of claim 7, wherein the flexural modulus of each sound panel is defined by at least one of a material composition of the sound panel, a set of physical dimensions of the sound panel, a mounting configuration of the sound panel, and a combination thereof.

10. The sound system of claim 7, wherein at least one of the plurality of sound panels define an interior portion of a vehicle.

11. The sound system of claim 7, wherein at least one of the plurality of sound panels define a roll over protection system portion of a vehicle.

12. The sound system of claim 7, further comprising an audio amplifier comprising a channel operatively coupled to each acoustic exciter, the channel configured to provide the single audio signal.

13. A method for a speakerless sound system comprising:

providing a first audio signal having a first frequency range on a first channel of an audio amplifier, wherein the first channel is operatively coupled to a first acoustic exciter, and the first acoustic exciter is coupled to a first sound panel formed of a material having a first flexural modulus;

providing a second audio signal having a second frequency range on a second channel of the audio amplifier, the second frequency range different than the first frequency range, wherein the second channel is operatively coupled a second acoustic exciter, and the second acoustic exciter is coupled to a second sound panel formed of a material having a second flexural modulus, the second flexural modulus different than the first flexural modulus;

generating a first range of sound pressure vibrations by the first sound panel dependent on the first flexural modulus, a first set of dimensions of the first sound panel, and the first audio signal; and generating a second range of sound pressure vibrations by the second sound panel dependent on the second flexural modulus, a second set of dimensions of the second sound panel, and the second audio signal.

14. The method of claim 13, wherein the first and second audio signals are unequalized.

15. The method of claim 13, wherein at least one of the first and the second sound panels define a portion of a passenger compartment of a vehicle.

16. The method of claim 13, wherein at least one of the first and the second sound panels define a roll over protection system portion of a vehicle.

17. The method of claim 13, further comprising generating a first sound signal by the first sound panel comprising the first range of sound pressure vibrations using the first audio signal and the first set of dimensions including at least a thickness of the first sound panel.

18. The method of claim 17, wherein the thickness of the first sound panel comprises a gradient along at least one of a length and a width of the first sound panel, the first flexural modulus in any area of the first sound panel being dependent on the thickness of the first sound panel in that area.

19. The method of claim 18, further comprising generating a second sound signal by the second sound panel comprising the second range of sound pressure vibrations using the second audio signal and the second set of dimensions including at least a thickness of the second sound panel.

20. The method of claim 19, wherein the thickness of the second sound panel comprises a gradient along at least one of a length and a width of the second sound panel, the second flexural modulus in any area of the second sound panel being dependent on the thickness of the second sound panel in that area.

* * * * *